US008584811B2

(12) United States Patent
Kuoppala et al.

(10) Patent No.: US 8,584,811 B2
(45) Date of Patent: Nov. 19, 2013

(54) ELEVATOR SYSTEMS AND METHODS TO CONTROL ELEVATOR BASED ON CONTACT PATTERNS

(75) Inventors: Hannu Kuoppala, Helsinki (FI); Reetta Ranne, Espoo (FI); Ari Hänninen, Hyvinkää (FI); Pekka Korhonen, Espoo (FI); Marja-Liisa Siikonen, Helsinki (FI); Janne Sorsa, Helsinki (FI); Jukka Salmikuukka, Espoo (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/529,255

(22) Filed: Jun. 21, 2012

(65) Prior Publication Data

US 2012/0305341 A1 Dec. 6, 2012

Related U.S. Application Data

(63) Continuation of application No. PCT/FI2010/051065, filed on Dec. 21, 2010.

(30) Foreign Application Priority Data

Dec. 22, 2009 (FI) ..... 20090503

(51) Int. Cl.
*B66B 1/34* (2006.01)

(52) U.S. Cl.
USPC ..... 187/392; 187/316

(58) Field of Classification Search
USPC ..... 187/247, 248, 313, 316, 317, 391–393; 49/26, 28; 318/280–286, 466–470, 318/481; 382/103–107
See application file for complete search history.

(56) References Cited

U.S. PATENT DOCUMENTS

| | | | | |
|---|---|---|---|---|
| 4,044,860 | A | 8/1977 | Kaneko et al. | |
| 4,951,786 | A | 8/1990 | Haraguchi | |
| 5,387,768 | A * | 2/1995 | Izard et al. | 187/392 |
| 5,487,451 | A * | 1/1996 | Hughes et al. | 187/392 |
| 6,257,373 | B1 * | 7/2001 | Hikita et al. | 187/392 |
| 6,339,375 | B1 * | 1/2002 | Hirata et al. | 340/541 |
| 6,386,326 | B2 * | 5/2002 | Pustelniak et al. | 187/317 |
| 7,031,525 | B2 * | 4/2006 | Beardsley | 382/199 |
| 7,079,669 | B2 * | 7/2006 | Hashimoto et al. | 382/118 |
| 7,140,469 | B2 * | 11/2006 | Deplazes et al. | 187/316 |

(Continued)

FOREIGN PATENT DOCUMENTS

| | | | |
|---|---|---|---|
| EP | 0968953 | A1 | 1/2000 |
| WO | WO-2005/118452 | A1 | 12/2005 |

OTHER PUBLICATIONS

International Search and Written Opinion.

*Primary Examiner* — Anthony Salata
(74) *Attorney, Agent, or Firm* — Harness, Dickey & Pierce, P.L.C.

(57) ABSTRACT

An elevator system includes at least one elevator, call-giving appliances in elevator lobbies, and a device configured to detect contact patterns in an identification area on a floor surface of at least one elevator lobby. A user to be connected to a call given from the elevator lobby is classified based on the contact pattern, the type data of the call is associated with the call based on the classification, and the call and the type data is transmitted to the control system of the elevator system to control the elevators.

23 Claims, 1 Drawing Sheet

(56) References Cited

U.S. PATENT DOCUMENTS

| | | | | |
|---|---|---|---|---|
| 7,400,744 | B2 * | 7/2008 | Nichani et al. | 382/103 |
| 7,712,586 | B2 * | 5/2010 | Legez | 187/391 |
| 7,735,611 | B2 * | 6/2010 | Tyni | 187/386 |
| 8,020,672 | B2 * | 9/2011 | Lin et al. | 187/392 |
| 8,260,042 | B2 * | 9/2012 | Peng et al. | 382/162 |
| 2007/0272493 | A1 | 11/2007 | Legez | |

* cited by examiner

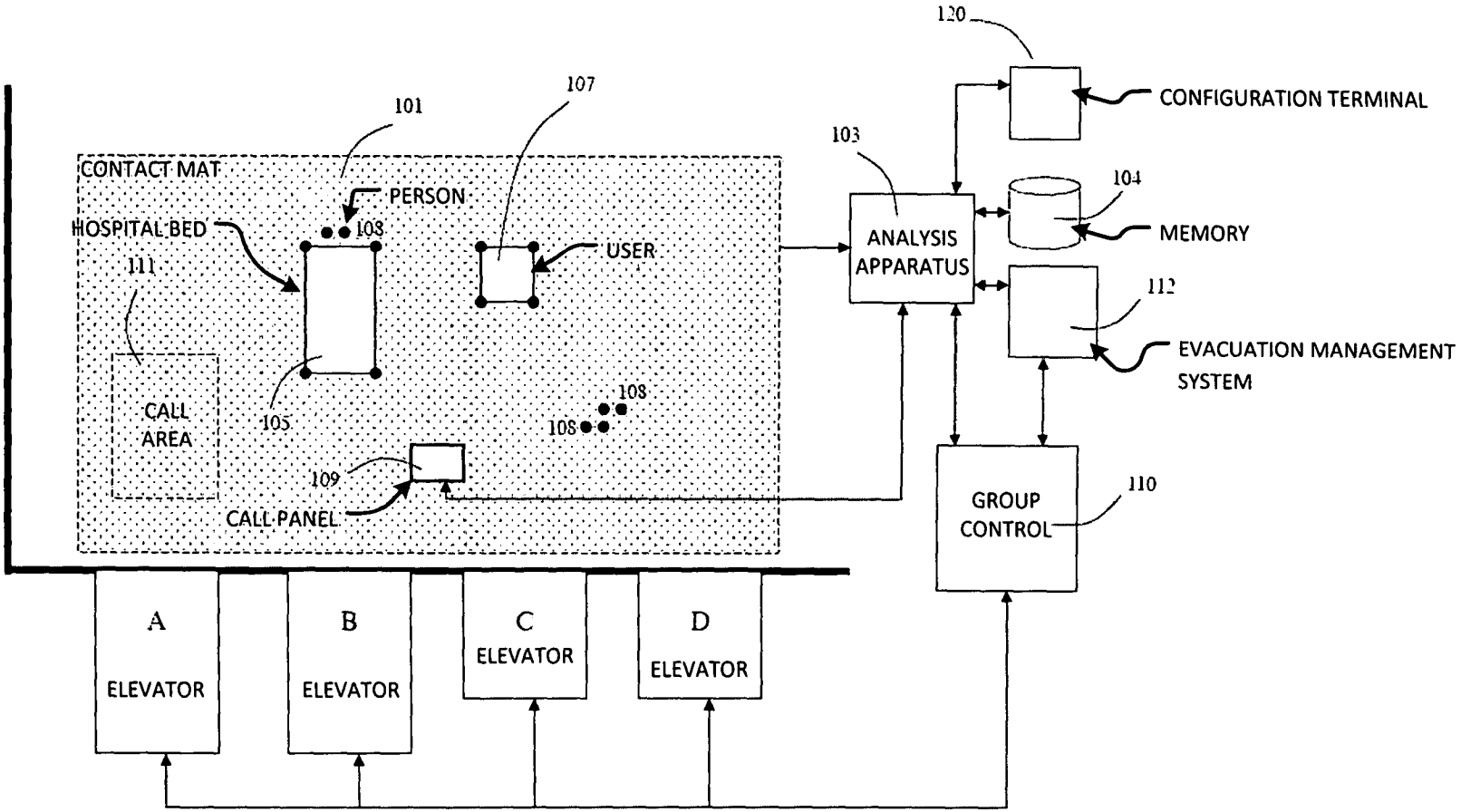
CONFIGURATION TERMINAL
MEMORY
EVACUATION MANAGEMENT SYSTEM
120
104
112
110
GROUP CONTROL
ANALYSIS APPARATUS
103
CONTACT MAT
HOSPITAL BED
111
CALL AREA
PERSON
108
101
105
CALL PANEL
109
USER
107
108
108
A ELEVATOR
B ELEVATOR
C ELEVATOR
D ELEVATOR

ELEVATOR SYSTEMS AND METHODS TO CONTROL ELEVATOR BASED ON CONTACT PATTERNS

CROSS-REFERENCE TO RELATED APPLICATIONS

This application is a continuation of International Application Number PCT/FI2010/051065 filed on Dec. 21, 2010 and claims priority to Finnish Application Number FI 20090503 filed on Dec. 22, 2009, the entire contents of each of which are hereby incorporated herein by reference.

FIELD OF THE INVENTION

The invention relates to a control of elevators. More particularly the invention relates to a method and to a system for the automatic type design of calls and for the control of elevators performed on the basis of typification.

BACKGROUND OF THE INVENTION

In elevator systems the giving of calls conventionally occurs with up/down pushbuttons in the elevator lobby, by means of which pushbuttons a passenger expresses his/her desired direction of travel and further, after the elevator has reached the floor on which the passenger is located, his/her desired destination floor by means of pushbuttons in the elevator car. To an increasing extent also so-called destination call systems are used, in which each passenger gives his/her personal destination call already at the departure floor before going into the elevator car. Often a problem in hospitals, senior citizens' housing and many other buildings is that loads of large size, such as hospital beds or wheelchairs, are moved with the elevators, and these take up a lot of the floor area of the elevator car in relation to their weight. In this case situations arise in which new passengers no longer fit into an elevator car, although on the basis of the measured car load there should be adequate free space in the elevator car. As a consequence, an elevator car serving a call stops unnecessarily at an elevator lobby even though the giver of the call does not fit into the elevator car, in which case the transport capacity of the elevator system decreases and passengers become frustrated because they must give their calls again and must wait for the next elevator.

Efforts have been made to solve this problem by adding to the call-giving appliances special pushbuttons that indicate the type of call, by means of which e.g. a passenger moving in a wheelchair can order an elevator car containing sufficient space for a wheelchair. Adding the aforementioned type pushbuttons to the call-giving appliances, however, easily makes the call-giving appliances complicated and confusing to use. In addition, it should be precisely known right from the installation phase of the elevator system which type pushbuttons will be needed during the operating history of the elevator system, because retrofitting new type pushbuttons to the call-giving appliances is an awkward and expensive, even sometimes impossible, procedure. Also the threshold limits of car load weighing devices, which are used to identify the degree of filling of elevator cars, must often be tuned to be unnecessarily small to avoid unnecessary stops.

AIM OF THE INVENTION

The aim of the present invention is to eliminate or at least to alleviate drawbacks presented above that occur in prior-art solutions presented above. The aim of the invention is also to disclose a solution with which one or more of the following objectives can be achieved:

- to improve the transportation capacity of elevator systems,
- to simplify call giving appliances,
- to take into account the needs of different user groups better than before in the elevator service,
- to speed up call-giving,
- to improve passenger comfort and the service level in elevator systems,
- a solution to which new user classes and call types can easily be added,
- to improve evacuation efficiency in exceptional circumstances,
- a solution which is suited for use in connection with conventional up/down pushbuttons as well as in connection with destination call panels.

SUMMARY OF THE INVENTION

Methods and elevator systems are disclosed. At least some embodiments of the invention are characterized by what is disclosed in the claims. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the scope of the basic inventive concept in conjunction with other embodiments.

The present invention discloses a method for controlling an elevator system. The elevator system comprises at least one elevator, call-giving appliances in the elevator lobbies, and means for detecting in the desired identification area contact patterns directed onto the floor surface of at least one elevator lobby. According to the invention at least one user to be connected to a call given from the elevator lobby is classified on the basis of the contact pattern produced by the user, the type data of the call is connected to the call on the basis of the aforementioned classification, and the call with its type data is transmitted to the control system of the elevator system for controlling the elevators. In this context the term user refers to any person, object or good whatsoever to be transported by elevators. The user produces on the floor surface a contact pattern that is characteristic of the user, on the basis of which contact pattern users can be classified and distinguished from each other. The user can be e.g. a person, a shopping trolley, a hospital bed, a freight trolley, a wheelchair, a suitcase, an escorter, etc. A user class can be specified by recording the characteristic reference patterns of the class in memory and by comparing the contact patterns produced by the user to the reference patterns recorded. A call refers in this context to a landing call given in the elevator lobby with the up/down pushbuttons, which call indicates the departure floor and travel direction of the user, or it can be a destination call given with a destination call panel, which destination call indicates the departure floor and destination floor of the user. The type data of the call refers to the information that determines the type of transport to be connected to the call, e.g. whether wheelchair transportation, patient transportation, freight transportation, passenger transportation, et cetera, is involved. Information about the number of people to be connected to a call can also be connected to the type data, if the passengers are traveling in a group.

The present invention also discloses an elevator system, which comprises at least one elevator, a control system of the elevator system, and also call-giving appliances in the elevator lobbies. At least one elevator lobby contains a contact mat for detecting contact patterns directed onto the floor surface of the lobby. The contact mat is connected to an analysis apparatus, which classifies at least one user to be connected to a call given from the elevator lobby on the basis of the contact pattern produced by the user. The analysis apparatus connects the type data to the call on the basis of the aforementioned classification and transmits the call with its type data to the control system of the elevator system for controlling the elevators.

In one embodiment of the invention a run profile to be connected to the call is determined on the basis of the type data of the call, according to which run profile the elevator car serving the call is controlled. A run profile refers to parameters and behavior rules, with which an elevator car is controlled during the service of a call, e.g. the travel speed of the elevator car, acceleration, open time of the doors of the elevator car, et cetera. As a result of the embodiment, travel comfort and travel safety improve because the special needs of users belonging to different classes can be taken into account better than before in the control of the elevators.

In one embodiment of the invention a call area is specified from the identification area and a call is automatically generated when a user belonging to a predefined class is detected in the call area. As a result of the embodiment, the call-giving of certain users can be automated and their arrival at destination speeded up.

In one embodiment of the invention at least two users to be connected to a call are identified and data defining the size of the group formed by the users in question is connected to the type data of the call. The data defining the size of a group is e.g. the number of persons belonging to a group and/or the space requirement of a group in an elevator car. A call is served with an elevator car containing adequate space for all the members of the group, in which case users belonging to the same group are not separated and do not lose each other when transferring from one floor to another.

In one embodiment of the invention the movement of users in the identification area is monitored. If it is detected that the user that gave the call departs from the identification area, the call given by the user is cancelled. As a result of the embodiment, unnecessary stops of the elevators, caused when a person decides to leave the elevator lobby after first giving his/her call to the elevator system, can be avoided.

In one embodiment of the invention the class of a user is determined by comparing the contact patterns produced by the user to predefined reference patterns.

The use of reference patterns can speed up classification and improve the reliability of classification.

In one embodiment of the invention new user classes are created by teaching the contact patterns characteristic of users utilizing a contact mat and by adding said patterns to the reference patterns used in the classification of users. In the embodiment, an object/good or other corresponding user belonging to a new user class is brought into the identification area and the contact pattern thus obtained is registered. As a result of the embodiment, the teaching of new user classes and of the reference patterns to be connected to them is quick and easy.

In one embodiment of the invention the presence of users in the identification areas during an exceptional situation is monitored. If users are detected in the identification areas, information about their presence and floor of location is transmitted to the elevator system and/or to the evacuation management system. As a result of the embodiment, evacuation of the building can be made more efficient and e.g. physically handicapped people can be rescued quickly and safely using the elevators.

In one embodiment of the invention the congestion prevailing in the elevator lobby and its degree of severity are identified. If congestion is detected, one or more elevator cars are sent to the congested elevator lobby. As a result of the embodiment, the waiting times of passengers in congestion situations can be shortened and the transport capacity of the elevator system can be directed to those floors on which there is most need for transport.

In one embodiment of the invention the movement of users in the identification area is monitored. If it is detected that a user is attempting to enter a wrong elevator car, a guidance message that warns about the wrong elevator car is generated. As a result of the embodiment, the going of passengers into a wrong elevator car and the unnecessary travel resulting from it can be reduced. For example, if the giver of a call has pressed the down pushbutton and he/she tries to enter an elevator which is going in the up direction, guidance means in the elevator car and/or in the elevator lobby guide the passenger to use some other elevator that is going downwards. In a destination call system the elevator car serving a user is known exactly, so it can be notified in a guidance message to a passenger trying to enter the wrong elevator car.

In one embodiment of the invention the transfer of users that have given calls into the elevator car serving the call is monitored and start permission is given to the elevator car on the basis of the aforementioned monitoring. As a result of the embodiment, the transport capacity of the elevator system can be made more efficient and arrival at destination speeded up, because the elevator car can be sent on a run immediately after all the users to be served with the elevator car have transferred into the elevator car.

In one embodiment of the invention the free space of the elevator car arriving at the elevator lobby is determined. If not even one of the potential users of the arriving elevator car that are in the elevator lobby fits into the elevator car, the elevator car is driven past the elevator lobby without stopping (a so-called by-pass function). A potential user refers to a user that, either on the basis of given calls and/or on the basis of the location of the user tries to enter an arriving elevator car. As a result of the embodiment, unnecessary stops can be avoided and at the same time the transport capacity of the elevator system can be improved.

With the solution according to the invention numerous advantages are achieved with respect to prior-art solutions. As a result of the present invention, call-giving can be speeded up and call-giving appliances can be simplified. The transport capacity of an elevator system can be improved by minimizing the number of unnecessary stops, by avoiding the unnecessary standing of elevator cars at the floor levels and by guiding passengers to the correct elevator cars. Adding new user classes is easy by teaching the contact pattern characteristic of a user class by utilizing the contact mat. With the solution according to the invention, evacuation can also be made more efficient by monitoring whether there are people in the elevator lobbies waiting for evacuation. By influencing the run profile of the elevator cars, passenger comfort and passenger safety improve. All in all the solution according to the invention improves the service level of passengers in elevator systems, because the special needs of different user classes can be automatically taken into account in the control of the elevators.

LIST OF FIGURES

In the following, the invention will be described in detail by the aid of some examples of its embodiments, wherein:

FIG. 1 presents an elevator lobby of an elevator system, in which lobby the solution according to the invention is applied.

DETAILED DESCRIPTION OF THE INVENTION

FIG. 1 presents by way of example one elevator lobby of a building, which lobby is served with the elevators A, B, C and D of an elevator group. A destination call panel 109 is disposed in the elevator lobby, which panel can also be a conventional call-giving appliance implemented with up/down pushbuttons. The floor surface of the elevator lobby is partly covered with a so-called contact mat 101, the identification elements in which detect the local contact or pressure produced onto the floor surface by an item or other object. The elements are e.g. elements that react to changes in capacitance or to changes in pressure. The elements are close to each other, e.g. a few millimeters or centimeters apart from each other, in order to achieve the desired resolution in the contact patterns. The contact mat 101 is connected e.g. with cables to the analysis apparatus 103 for transmitting contact patterns expressed by the contact mat to the analysis apparatus. Software is installed in the analysis apparatus, which software when run on the processor apparatus classifies the users on a contact mat into predefined classes, connects the type data of the call to the call given by a user on the basis of the aforementioned classification and transmits the call with its type data to the group control 110 of the elevator group. The analysis apparatus is provided with memory means 104 for recording the information needed in the classification of users. In FIG. 1 the analysis apparatus is a separate apparatus, but its functionality can be integrated either partly or wholly into the control system of an elevator system and/or into the call-giving appliances in elevator lobbies.

In FIG. 1 a hospital bed is marked with the reference number 105, the contact pattern (in FIG. 1 four black spots at the corners of the hospital bed) formed by the contact points of which the analysis apparatus compares to the reference patterns recorded in the memory means 104. When a sufficient correlation is found between a contact pattern detected and a recorded reference pattern, the analysis apparatus can deduce which class the user being monitored belongs to, which in this example case is "hospital bed". Correspondingly, the analysis apparatus can deduce that the user 107 belongs to the "wheelchair" class and that the users 108 belong to the "person" class. When a person in a wheelchair 107 gives a call with a call-giving appliance 109 that is in the elevator lobby, the call is transmitted to the analysis apparatus 103, which classifies the giver of the call as belonging to the "wheelchair" class on the basis of the contact pattern indicated by the contact mat 101. The analysis apparatus connects the type data "wheelchair transport" to the call and sends the call with its type data to the group control 110. The group control allocates a suitable elevator car for collecting the wheelchair passenger from the elevator lobby and for taking him/her to the destination floor according to the call. The allocated elevator can be indicated to the giver of the call with the display means in the destination call panel 109. The group control takes into account the type data of the call by reserving an elevator car from those elevator cars containing adequate space for a wheelchair passenger; in certain embodiments an elevator car that is empty can always be allocated. In addition, a run profile for wheelchair transport has been recorded in the group control, in which profile the door times of the elevator have been lengthened and/or the door speeds reduced.

The analysis apparatus 103 monitors the movement of users in the elevator lobby on the basis of the contact patterns indicated by the contact mat 101. If a user, who has given his/her call, leaves the area (the identification area) delimited by the contact mat, the analysis apparatus sends information about his/her leaving to the group control. The group control removes the call from the list of calls to be served and releases the elevator car allocated to the call for other use. Correspondingly, if a user to whom an elevator car has been allocated attempts, on the basis of the monitoring, to enter a wrong elevator car, a guidance message is generated, which warns the user about the wrong elevator car and also, if necessary, guides him/her to the door of the correct elevator car. The guidance message is expressed auditively and/or visually, e.g. with guidance means (not presented in FIG. 1) in the elevator car.

A special call area is marked in FIG. 1 with a dashed line 111, which special call area is used for the generation of automatic calls. Information about those user classes that generate an automatic call is recorded in the memory means 104. If, for example, "hospital bed" is a user class that generates an automatic call and if the analysis apparatus detects that a hospital bed is coming into the call area 111, the analysis apparatus sends to the group control a landing call that is of the type "patient transportation". If some user other than "hospital bed" is detected in the call area, a call is not generated. On the basis of the call, the group control sends to the elevator lobby an elevator car that has adequate space for a hospital bed and for at least one escorter. If for reasons of hygiene, or for other reasons, it is desired to use a certain elevator car, e.g. elevator car A, for transportations of hospital beds, the group control sends the elevator car A to the elevator lobby in response to an automatically generated call.

The analysis apparatus 103 can, on the basis of the monitoring of the movements of users, make deductions on which users probably belong together, i.e. form a group, which should be served with the same elevator car. For example, if a four-person group arrives in the elevator lobby and one of the members of the group gives a call, the analysis apparatus specifies the call to be of the "person transport" type, connects the size of the group (4 persons) to the type data and transmits the call with its type data to the group control. The group control allocates an elevator car with adequate space for four persons to the use of the group.

The analysis apparatus can, on the basis of the monitoring of the movements of users, make deductions on when the users allocated to a certain elevator car have transferred into the elevator car in question. When the analysis apparatus detects that there are no more users in the elevator lobby that are going into to elevator car, it sends to the group control the start permission of the elevator car in question, as a result of which permission the doors of the elevator car close and the elevator car leaves according to the registered calls towards the next stopping floor.

The analysis apparatus can, on the basis of the monitoring of users, make deductions about the congestion of an elevator lobby and its degree of severity. In order to identify congestion and to determine its degree of severity, the analysis apparatus determines e.g. the numbers of users in an elevator lobby and/or the average waiting times of the elevators. If a number and/or an average waiting time exceeds the given threshold value, the analysis apparatus sends to the group control information about the congestion and its degree of severity, e.g. information about the number of users in an elevator lobby and/or the average waiting time. In this case the group control automatically sends one or more elevator cars to the congested elevator lobby, depending on the degree of severity of the congestion.

In FIG. 1 the evacuation management system is marked with the reference number 112, which evacuation management system is connected to the group control 110 and to the analysis apparatus 103. When some exceptional situation, e.g. a fire, is detected in the building the management system 112 sends information about the floors to be evacuated to the analysis apparatus and/or to the group control. The analysis apparatus starts to send to the group control information about the numbers and classes of users in the elevator lobbies of the floors to be evacuated. The group control, on the basis of the information of the analysis apparatus, sends elevator cars to the floors to be evacuated taking into account the classification data in the prioritization of the evacuation sequence of the floors. The evacuation management system is presented in FIG. 1 as a separate system, but its functionality can be integrated either partly or wholly into the control system of the elevator system and/or into the analysis apparatus.

The analysis apparatus comprises a configuration terminal 120, by means of which the data needed in the classification of users can be edited and also new user classes can be created. For teaching new user classes, a user representing the class to be taught, e.g. a shopping trolley, is brought into the identification area 101. A record command is given from a configuration terminal or from a call-giving appliance 109, as a consequence of which the analysis apparatus adds the contact pattern produced by the shopping trolley in the identification area to the reference patterns that are in the memory means 104. In addition, by means of the configuration terminal a run profile can be connected to the new "shopping trolley" class, which run profile is used when transporting shopping trolleys in the elevator cars.

In the elevator system according to FIG. 1 the free space (free useful floor area) of an elevator car arriving at an elevator lobby is determined. Information about the arriving elevator car and about its free space are transmitted to the analysis apparatus which determines the space requirement of the potential passengers, and if not even one of the potential passengers fits into the arriving elevator car, the analysis apparatus sends by-pass data to the group control, as a result of which the elevator car is driven past the elevator lobby without stopping if there are no users in the elevator car that are leaving the elevator car at the elevator lobby in question. The free space of elevator cars can be determined with conventional car load weighing devices, or by installing a contact mat in the elevator cars and by analyzing the contact patterns produced by users that are in the elevator cars, as has been described above. Yet another possibility for determining the free space of elevator cars is to monitor the users going into elevator cars and the users coming out of them in all the elevator lobbies of the elevator system by means of contact mats in the elevator lobbies as well as by means of an analysis apparatus.

The invention is not only limited to be applied to the embodiments described above, but instead many variations are possible within the scope of the inventive concept defined by the claims below. Thus, for example, the elevator system can comprise a number of elevator groups, which have shared call-giving appliances.

The invention claimed is:

1. A method for controlling an elevator system, the method comprising:

classifying at least one user to be connected to a call from an elevator lobby based on a contact pattern produced by the user in an identification area of the elevator lobby;

associating type data with the call based on the classification of the user; and transmitting the call and the associated type data to a control system of the elevator system for controlling elevators in the elevator system.

2. The method according to claim 1, wherein the classifying the user comprises:

determining a class of the user by comparing the contact pattern produced by the user with at least one reference pattern.

3. The method according to claim 1, further comprising:

determining a run profile to be associated with the call based on the type data; and controlling an elevator serving the call according to the determined run profile.

4. The method according to claim 1, further comprising:

specifying at least one call area from the identification area; and automatically generating a call when a user belonging to a class is identified in the call area.

5. The method according to claim 1, further comprising:

identifying at least two users to be connected to a call; and connecting data defining a size of a group formed by the users to a type data for the call.

6. The method according to claim 1, further comprising:

monitoring movement of users in the identification area; and canceling a call given by a first of the users when departure of the first user from the identification area is detected.

7. The method according to claim 1, further comprising:

adding a contact pattern produced by a user in the identification area as a reference pattern to create a new user class used in classifying users.

8. The method according to claim 1, further comprising:

monitoring the presence of users in the identification area during an exceptional situation; and transmitting information about the presence and location of the users to at least one of the elevator system and an evacuation management system.

9. The method according to claim 1, further comprising:

identifying congestion in the elevator lobby and a degree of severity of the congestion; and sending one or more elevator cars to the elevator lobby based on the congestion and the degree of severity of the congestion.

10. The method according to claim 1, further comprising:

monitoring movement of users in the identification area; and generating a guidance message for at least one of the users in response to detecting that the at least one of the users is attempting to enter a wrong elevator car.

11. The method according to claim 1, further comprising:

monitoring transfer of users that have given a call into an elevator car serving the users; and providing start permission to the elevator car based on the monitoring.

12. The method according to claim 1, further comprising:

determining free space of an elevator car arriving at the elevator lobby;

driving the elevator car past the elevator lobby without stopping if no potential users of the elevator car in the elevator lobby will fit into the elevator car.

13. An elevator system comprising:

at least one elevator;

a control system;

a call-giving appliance in an elevator lobby;

a contact mat in the elevator lobby, the contact mat delimiting an identification area, and being configured to detect contact patterns on a floor surface in the identification area of the elevator lobby;

an analysis apparatus connected to the contact mat, the analysis apparatus being configured to, classify at least one user to be connected to a call from the elevator lobby based on a contact pattern produced by the user, associate type data for the call to the call based on the classification, and transmit the call and the type data to the control system to control the at least one elevator.

14. The elevator system according to claim 13, wherein the analysis apparatus comprises:

a memory configured to record a plurality of reference patterns; wherein the analysis apparatus is further configured to classify the user by comparing the contact pattern to the recorded reference patterns.

15. The elevator system according to claim 13, wherein the elevator system is configured to determine a run profile to be connected to the call based on the type data for the call, and to control an elevator serving the call according to the run profile.

16. The elevator system according to claim 13, wherein the analysis apparatus is configured to identify a user that belongs to a class and that is in a call area located in the identification area, the analysis apparatus being further configured to automatically generate a call based on the identification.

17. The elevator system according to claim 13, wherein the analysis apparatus is configured to identify at least two users to be connected to a call, and to connect data defining a size of a group formed by the at least two users to the type data for the call.

18. The elevator system according to claim 13, wherein the analysis apparatus is configured to monitor movement of users in the identification area, and send a call-cancellation command to the control system based on the monitored movement when a first of the users that has given a call has left the identification area.

19. The elevator system according to claim 13, wherein the analysis apparatus is configured to add, as a reference pattern used in the classification, a contact pattern produced by a user in the identification area.

20. The elevator system according to claim 13, wherein the analysis apparatus is configured to transmit, in response to an exceptional situation, presence and location information for users in the identification area to at least one of the control system and an evacuation management system.

21. The elevator system according to claim 13, wherein the analysis apparatus is configured to identify congestion in the elevator lobby and the degree of severity of the congestion, and to transmit information about the congestion and the degree of severity of the congestion to the control system, and wherein the control system is configured to send one or more elevator cars to the elevator lobby based on the information.

22. The elevator system according to claim 13, wherein the analysis apparatus is configured to monitor the transfer of one or more users that have given a call into the elevator car serving the call, the analysis apparatus being further configured to send start permission for the elevator car based on the monitored transfer.

23. The elevator system according to claim 13, wherein the elevator system is configured to determine free space of an elevator car arriving at the elevator lobby, and to drive the elevator car past the elevator lobby without stopping if no potential users of the elevator car in the elevator lobby will fit into the elevator car.

* * * * *